US010427065B2

(12) United States Patent
Murthy et al.

(10) Patent No.: US 10,427,065 B2
(45) Date of Patent: Oct. 1, 2019

(54) BUILDING BLOCKS WITH LIGHTS FOR GUIDED ASSEMBLY

(71) Applicant: Intel Corporation, Santa Clara, CA (US)

(72) Inventors: Karthika Murthy, Bangalore (IN); Nischith Honnavar, Bengaluru (IN); Vishwa T. Kondaveeti, Hyderabad (IN)

(73) Assignee: Intel Corporation, Santa Clara, CA (US)

( * ) Notice: Subject to any disclaimer, the term of this patent is extended or adjusted under 35 U.S.C. 154(b) by 10 days.

(21) Appl. No.: 15/476,042

(22) Filed: Mar. 31, 2017

(65) Prior Publication Data

US 2018/0280822 A1 Oct. 4, 2018

(51) Int. Cl.

| | |
|---|---|
| ***A63H 33/04*** | (2006.01) |
| ***A63H 33/26*** | (2006.01) |
| ***A63H 33/08*** | (2006.01) |
| ***A63H 33/22*** | (2006.01) |
| *A63H 5/00* | (2006.01) |

(52) U.S. Cl.

CPC ..... *A63H 33/042* (2013.01); *A63H 33/086* (2013.01); *A63H 33/22* (2013.01); *A63H 33/26* (2013.01); *A63H 5/00* (2013.01); *A63H 2200/00* (2013.01)

(58) Field of Classification Search

CPC ... A63H 33/04; A63H 33/042; A63H 2200/00

See application file for complete search history.

(56) References Cited

U.S. PATENT DOCUMENTS

| | | | | |
|---|---|---|---|---|
| 5,823,782 | A * | 10/1998 | Marcus | G09B 1/06 434/156 |
| 2002/0196250 | A1* | 12/2002 | Anderson | G06T 19/00 345/420 |
| 2010/0001923 | A1* | 1/2010 | Zilber | A63F 3/00643 345/1.1 |
| 2012/0258436 | A1* | 10/2012 | Lee | G09B 19/00 434/362 |
| 2014/0142900 | A1* | 5/2014 | Andre | G06F 17/50 703/1 |
| 2015/0125835 | A1* | 5/2015 | Wittich | A63H 33/042 434/169 |

(Continued)

*Primary Examiner* — Eugene L Kim
*Assistant Examiner* — Alyssa M Hylinski
(74) *Attorney, Agent, or Firm* — Schwegman Lundberg & Woessner, P.A.

(57) ABSTRACT

Techniques are disclosed for assembling a set of connectable building blocks by using a computing device to access, from wireless communication elements in each block, general information regarding the set of blocks and specific information regarding at least one block of the set that is placed on a conducting mat and each block of the set that is connected to the at least one block on the conducting mat. Structural information regarding structures for assembly using the blocks is accessed based on the general and specific information. A process for assembling a selected structure using the blocks is generated based on all of the accessed information. A lighting element of the at least one block (or a connected block) and a lighting element of at least one block of the set that is not connected to any other block of the set is made to blink based on the process.

19 Claims, 8 Drawing Sheets

(56) References Cited

U.S. PATENT DOCUMENTS

| | | | | |
|---|---|---|---|---|
| 2015/0246293 | A1* | 9/2015 | Kokhan | A63H 33/042 446/91 |
| 2016/0101370 | A1* | 4/2016 | Madsen | A63H 33/042 446/91 |
| 2016/0310861 | A1* | 10/2016 | Hirata | A63F 13/327 |
| 2016/0310862 | A1* | 10/2016 | Shi | A63H 33/042 |

* cited by examiner

350

| ID NUMBER | SHAPE | COLOR | CONNECTIONS | POSITION |
|---|---|---|---|---|
| 1001 | Shape 1 | Color 1 | 1002 and 1003 | Position 1 (x, y) |
| 1002 | Shape 2 | Color 2 | 1001 and 1003 | Position 2 (x, y) |
| 1003 | Shape 3 | Color 3 | 1001 and 1002 | Position 3 (x, y) |
| ... | ... | ... | ... | ... |

BUILDING BLOCKS WITH LIGHTS FOR GUIDED ASSEMBLY

TECHNICAL FIELD

Embodiments described herein generally relate to connectable building blocks and, more particularly, to assembling structures with a set of building blocks according to instructions received via wireless communication elements of each block and communicated to a user via lighting elements of each block.

BACKGROUND

Building blocks may be implemented in many different sizes and shapes which may be interconnected with similarly configured blocks in building block sets, such as available from the LEGO® group of companies. For example, the blocks may comprise hollow box-shaped structures provided with connection elements in the form of cylindrical studs located at evenly-spaced positions in regular arrays on tops of the blocks. Open cavities may be defined by inside surfaces of tops and sides of the blocks, and the blocks may be interconnected by inserting the studs of one block into the open cavities of another block of the set. These building blocks may, for example, be made of molded thermoplastic material. Furthermore, these building blocks may include one or more integrated electrical elements (e.g., circuit chips) embedded within the molded materials. Still further, an electrical connection of the electrical elements of connected blocks may be established by electrical leads incorporated within each of the blocks for connection to like electrical leads of other blocks of the set.

Typically, such building block sets comprise a set of building blocks suitable for assembling one or more building block structures, e.g. a house, a robot, a car, an airplane, a spaceship, a castle, or the like. Such building block sets often include printed assembly instructions that illustrate how to construct a certain structure using the building blocks of the set. However, an important feature of such building block sets is that they inspire users (e.g., children) to create their own structures.

Building block sets may provide assembly instructions comprising a sequence of pictures illustrating, step by step, how and in which order to add the building blocks to the structure (e.g., a house) being modeled. Such assembly instructions may have the advantage that they are easy to follow, even for children without much experience in assembling building blocks and/or without reading skills. However, such printed instructions may not be flexible enough to assist users in modeling new structures based on a dynamic user placement and connection of blocks of the set.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings.

DETAILED DESCRIPTION

Block Set Architecture

Figure 1B:
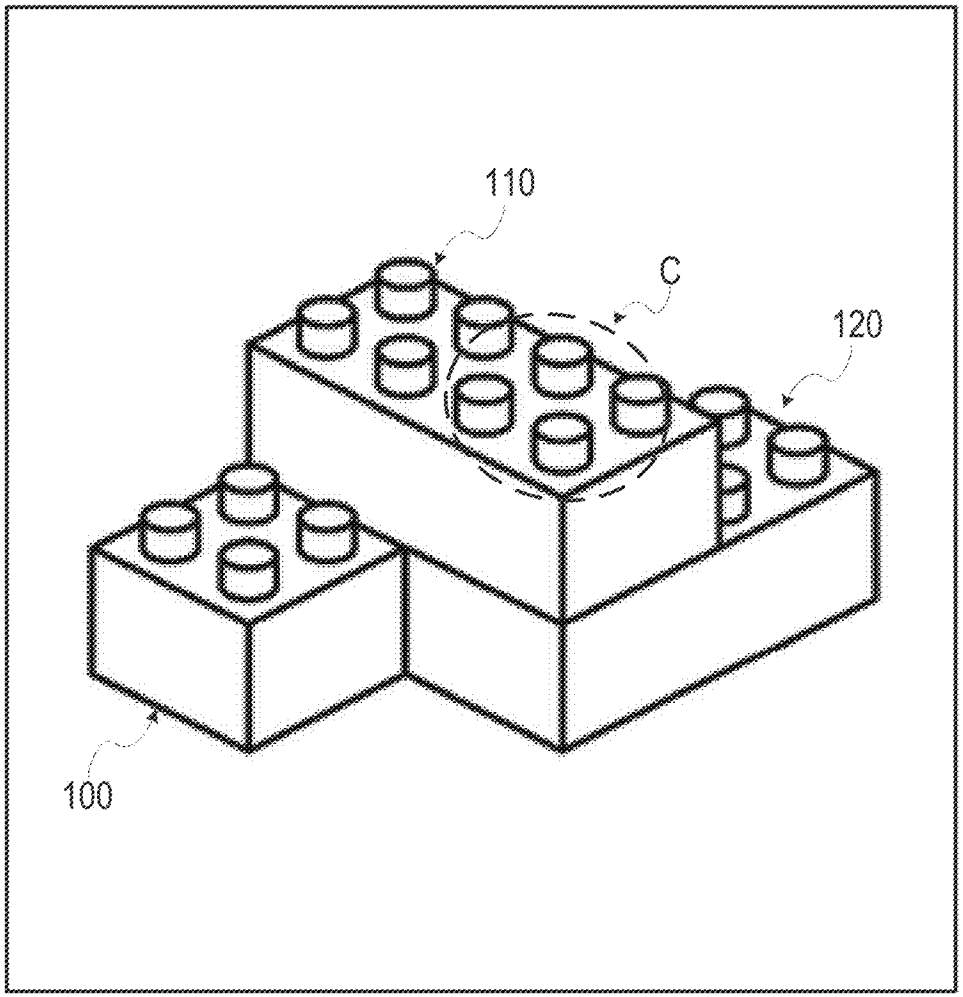
FIG. 1B is a depiction of the two example building blocks, of the building block set, connected to each other at the locations where the lighting elements were blinking to indicate a block to block connection.

Embodiments described herein are directed to smart building blocks which may make use of the Internet of things (IoT). The IoT is the inter-networking of physical devices (also referred to as "connected devices" and "smart devices") and other items embedded with electronics, software, sensors, actuators, and network connectivity that enable these devices/items to collect and exchange information. In some embodiments, an application (e.g., running on a user's computing device) may provide assembly instructions (e.g., obtained via the internet) to the building blocks so that the building blocks may provide visual feedback (e.g., lights) to the user to indicate block to block connections needed to assemble a specific structure. In this way, children could be assisted in building complex structures while also learning pattern matching from the blinking lights of blocks that are to be connected according to the assembly instructions.

In some embodiments, lighting elements such as light emitting diodes (LEDs) are used to create light patterns for indicating the next block to block connection to the user. Furthermore, a structure being assembled with the blocks by a user may be dynamically modified based on the progress that the user has made. For example, there may be two-way wireless communication between the application (on the user's computing device) and the building blocks through which the building blocks may communicate to the application that the user has strayed from the current assembly instructions by connecting blocks that were not indicated for connection by the blinking lights of the blocks. In this situation, the application may search for new structure assembly instructions (e.g., over the internet or from a known database of assembly instructions) that match the connection of blocks that the user has so far assembled (e.g., on a conducting map as explained below) so that the user may build new and even unexpected structures.

In some embodiments, along with the building blocks, the building block set may include a conducting mat on top of which the user will be instructed (e.g., via the above-noted blinking lights) to assemble the building blocks into a structure. The basic concept of such a conducting mat is similar to that of an electronic circuit breadboard. A breadboard is a construction base for circuits that does not require soldering and is therefore easily reusable. This makes it easy to use for creating temporary prototypes (e.g., building block structures) and experimenting with circuit design. The conducting mat may be used to identify the position of the building blocks placed at the first level of any building block structure as explained more fully below with respect to FIG. 3A-3B.

Furthermore, in some embodiments, the building blocks will initially be in an inactive state (e.g., no blinking lights or wireless communications) and will only come into an active state when connected with the conducting mat (e.g., placed on the conducting mat). Based on the position of the building blocks on top of the conducting mat material (e.g., x and y coordinates), a virtual picture of the first layer (e.g., ground floor) of a possible structure to be created using the building blocks may be generated in the application running on the user's computing device.

Figure 1A:
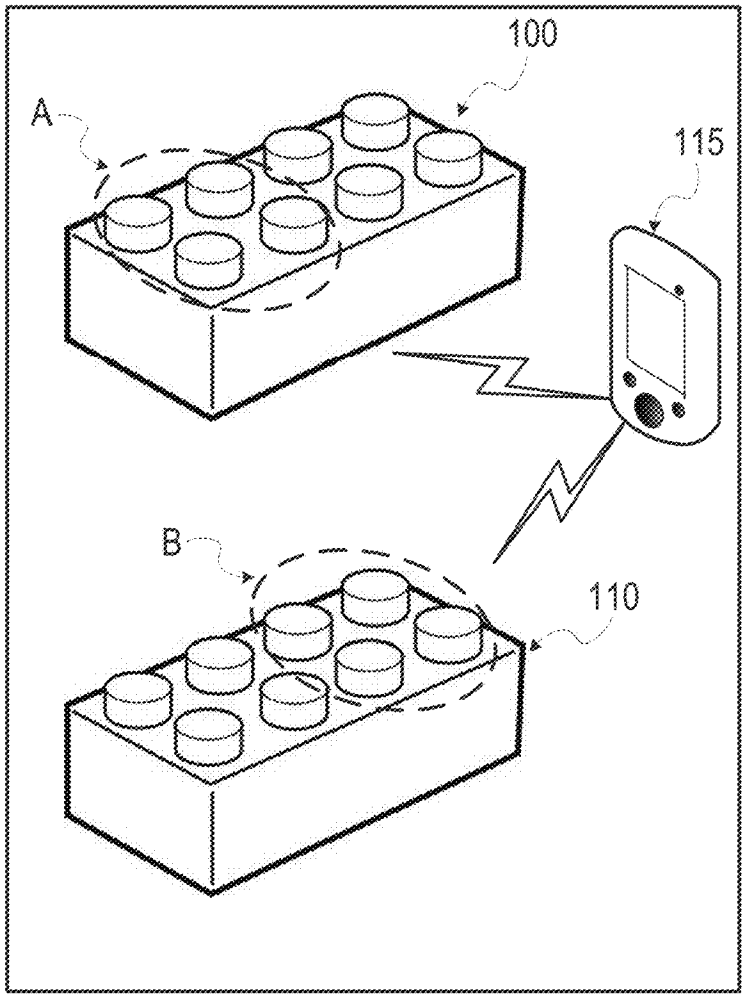
FIG. 1A is a depiction of two example building blocks, of a building block set, with blinking lighting elements for indicating block to block connection instructions.

FIG. 1A is a depiction of two example building blocks 100 and 110, of a building block set, with respective blinking lighting elements A and B for indicating block to block connection instructions.

During periods when the building blocks 100 and 110 of an example building block set are not being used, the building block set may be stored in a container that provides electric power (e.g., via wireless charging) for maintaining a charge (e.g., in a battery) in each of the building blocks of the set, such as blocks 100 and 110. The charge maintained in each of the blocks allows the blocks to respond (e.g., wireless transmission) when a building block application, running on the user's computing device 115, initially requests information regarding the blocks in order to provide interactive assembly instructions. The blocks may then return the requested information via their charged wireless communication elements. The information may include specific information about each block (e.g., location of blocks 100 and 110 on the conducting mat) and the general information regarding the building block set (e.g., how many L-shaped blocks) as described more fully below with respect to FIG. 3B.

The building block application may then, based on the requested information, access structural information (e.g., shapes, heights, widths, lengths, etc.) of possible physical structures to be modeled using the building blocks of the set from a known location (e.g., database of pre-defined structures) or via a search over a network such as the internet. After the user has selected one of the accessed structures for assembly using the set of blocks (e.g., via a user interface of the building block application), the building block application may generate (or access from a known location) a process for assembling the structure by connecting specified blocks of the building block set in an ordered sequence of connections.

The building block application may then cause a lighting element A of building block 100 (that is on the conducting map or connected to another block of the set that is on the mat) and a lighting element B of building block 110 (that is not on the conducting map or connected to another block of the set) to blink in a same pattern based on the process's sequence indicating that these two blocks are to be connected at the location of the blinking lighting elements A and B. It is noted that the blinking lighting elements A and B indicate that a block to block connection between areas of blocks 100 and 110, which respectively include 4 studs each, is instructed by the process. However, the blinking lighting elements A and B may denote any equally sized (e.g., same number of connective studs/cavities) area of the building blocks 100 and 110 for connection. Furthermore, the lighting elements A and B may be of different colors selected based on the respective colors of blocks 100 and 110. For example, colors of the lighting elements A and B may be selected so that they contrast with the colors of their respective blocks 100 and 110 by at least a specified amount (e.g., threshold contrast value). Still further, the blinking lighting elements A and B may denote respective areas for connection which, if the connection is implemented by the user, will result in other connections necessarily being made as describe with respect to FIG. 1B below.

FIG. 1B is a depiction of the two example building blocks 100 and 110, of the building block set, connected to each other at the locations where the lighting elements A and B were blinking to indicate a block to block connection.

As noted above with respect to FIG. 1A, the respective blinking lighting elements A and B of building blocks 100 and 110 indicate to the user that the blocks 100 and 110 are to be connected at the location of the blinking lights. For example, blocks 100 and 120 may be placed on the conducting mat, after which the building block application (which may launch based on a signal from the first block 100 placed on the conducting mat) may assign identification numbers to blocks 100 and 120 and request specific information (e.g., shape, size, color, etc.) about the blocks 100 and 120 before issuing any instructions (e.g., via the blinking lights) for assembly of any block structures. The requested information may also include the identification numbers assigned to any block to which a responding block is connected. The connected blocks may transmit information to each other via wireless communications or via electrical connections between the connected blocks which allow for the transmission of power and/or information between connected blocks.

After or before the building blocks 100 and 120 have provided the requested specific information to the building block application, the building block application may broadcast a request for specific information from the remaining blocks of the set (e.g., still in their container or within a threshold distance from the container or the computing device 115) so that a structure may be selected for assembly based on the building blocks that are available. Determining which blocks of the building block set are available for use will be discussed further below with respect to FIG. 2. Once the building block application has the requested information from all available blocks and a suggested structure has been selected by the user for assembly, the building block application may generate a process for assembling the selected structure using blocks 100 and 120 on the conducting mat as the initial blocks. The process will define an ordered sequence of block connections with the first connection being a connection between a block that is not connected to any other blocks and not already on the conducting mat and at least one of blocks 100 and 120 that are already on the conducting mat.

In the example of FIG. 1A, the building block application has instructed respective lighting elements A and B of blocks 100 (on conducting mat) and block 110 (not on the conducting mat or connected to any other block) to start blinking in a same pattern to indicate to the user that blocks 100 and 110 are to be connected in the region of lighting elements A and B. Assuming that the building block set includes 100 blocks and 25 of the blocks are identical (e.g., same size, shape and color), the building block application will instruct all of the identical blocks (that are not connected or on the conducting mat) to blink in the same pattern so that the user will know that the next block to block connection in the sequence of connections required to assemble the selected block structure may be satisfied by connecting any of the blinking blocks.

In some embodiments, the building block application running on the user's computing device 115 may be controlling the electronics of hundreds or even thousands of building blocks and in these situations so many Bluetooth connections may not be efficient or even possible. In these situations, the building block application may rely on another mode of communication like near field communication (NFC), raw radio waves, Wi-Fi, or a use of a Bluetooth hub in order to use a broadcasting technique to send/receive messages to blocks of the building block set.

After the user has connected blocks 100 and 110 at the locations of lighting elements A and B, the building block application may cause the lighting elements to stop blinking based on the connection of blocks 100 and 110. The building block application may then proceed to the next connection specified by the process in the sequence of connections to assemble the selected structure and instruct the relevant lighting elements of the next blocks to be connected according to the process to blink their lighting elements (e.g., LED 210) in a matching pattern so that the user will know that these two blocks are to be connected at the locations of the blinking lights.

As noted above, the implementation of the connection between blocks 100 and 110 may result in other block to block connections necessarily being made. In the example of FIG. 1B, the connection between blocks 100 and 110 at the locations of their respective lighting elements A and B has resulted in a connection between blocks 110 and 120 at the location of lighting element C of block 110 and a corresponding location of block 120 which is not visible in the example. This type of connection may be needed to connect blocks that are on the conducting mat but that are not connected to each other or even connected to the conducting mat if the mat does not include studs for connection to the cavities of the blocks placed on the conducting mat.

In some embodiments, the user may refuse to connect blocks 100 and 110 as indicated by the blinking lighting elements A and B, and instead may connect a block of the block set that is not blinking its lights to the connected blocks of the structure being assembled. In this situation, the building application will attempt to re-access structural information for possible building block structures to be built based on the new combination of connected blocks resulting from the user's choice to connect a block that was not indicated for connection according to the process of the structure that had been previously selected for assembly using the building block set. Once new structural information has been accessed by the building block application, new structures may be presented to the user (e.g., in user interface of building block application) for selection so that the selected structure may be built using the building block set.

Accordingly, the building block set allows a user to assemble even complex structures without the need for reading any explicit instructions (printed or electronic) by indicating each sequential block to block connection necessary to assemble a user-selected block structure via matching blinking light patterns at the locations for connection between the blocks.

Figure 2:
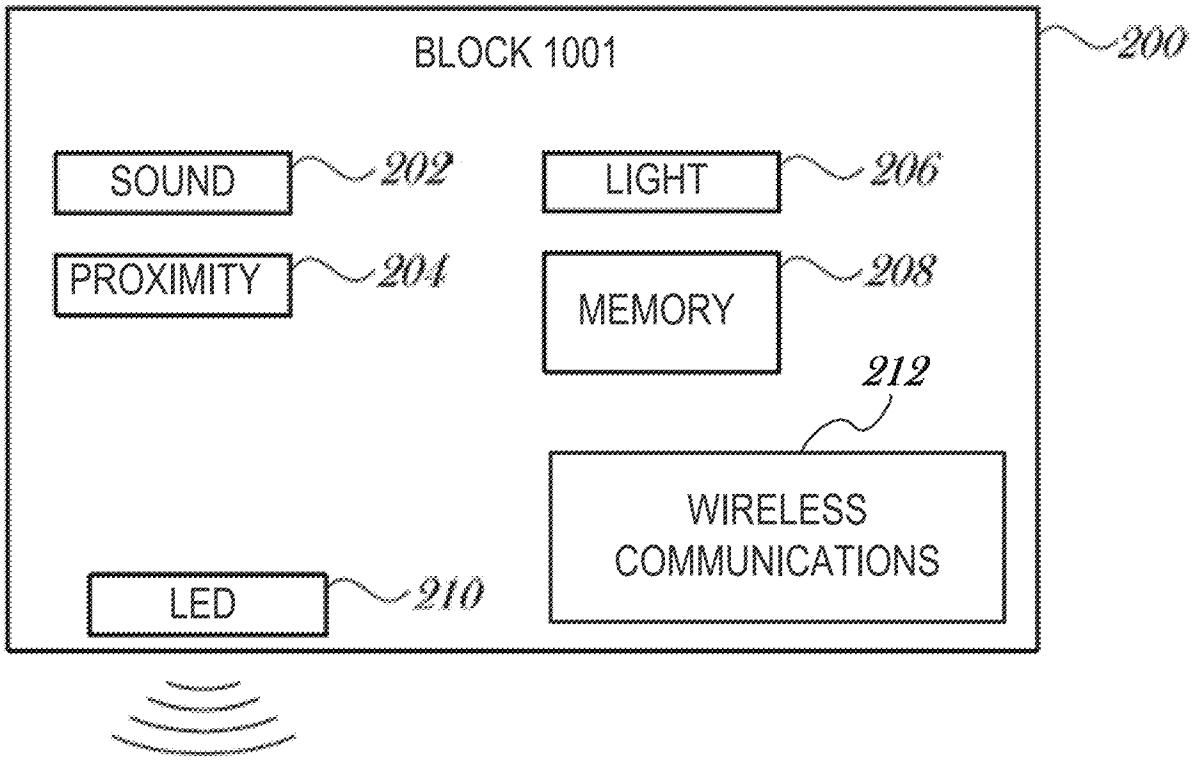
FIG. 2 is a block diagram illustrating example electrical elements of an example building block of the building block set.

FIG. 2 is a block diagram illustrating example electrical elements 202, 204, 206, 208, 210 and 212 of an example building block 200 of the building block set.

As noted above the blocks of the building block set may include one or more integrated electrical elements embedded within the molded materials. For example, block 200 includes a sound sensor 202, a proximity sensor 204 and a light sensor 206. As noted above, after or before the building blocks 100 and 120 have provided the requested specific information to the building block application, the building block application may broadcast a request for specific information from the remaining blocks of the set (e.g., still in their container or within a threshold distance from the container or the computing device 115) so that a structure may be selected for assembly based on the building blocks that are available. In some embodiments, the sensors 202, 204 and 206 may each play a role in this determination of available building blocks. When the building block application broadcasts a request for specific information from the blocks of the set, block 200 may first check its sensor data before it responds to the request from the building block application. For example, if the sound sensor 202 indicates a noise level around block 200 that is very different (e.g., beyond threshold difference value) from the average noise level of the other blocks (e.g., indicating that it is far away and may be lost) then the block 200 may remove itself from consideration by the building block application by not responding to the request for specific information. Alternatively, if the proximity sensor 204 indicates that there is nothing near block 200 (e.g., within a threshold distance value) then it may also be assumed that block 200 may be lost and should not respond to the building block application's request. Another possibility is that light sensor 206 indicates that a threshold level of light is not present near block 200 in which case it may be assumed that the block is lost (e.g., under a bed or under a couch) and should not respond to the building block application's request.

In embodiments, the block 200 includes a lighting element in the form of LED 210 which is capable of blinking in patterns as instructed by the building block application via the wireless communications element 212 (e.g., Bluetooth. NFC, Wi-Fi or radio communication elements) of block 200. As noted above the LED 210 may light up in a color that is selected based on the color of the block 200 or based on the readings of the light sensor 206 or a combination of both. In some embodiments the pattern of the blinking LED 210 may reflect the percentage of completion of the building block structure (e.g., how many of the sequential connections have been made) with a faster blinking as the percentage of completion increases. Furthermore, once the building block structure is completed, a celebratory pattern of blinking lights may be implemented by the building block application on the blocks used to assemble the structure. For example, a celebratory pattern may comprise a fast alternating sequence of differently colored lights around the perimeter of the structure.

In some embodiments, the block 200 includes a memory 208 to store the specific information associated with the block 200. As noted above, this information may include a size, shape or color of block 200. Furthermore, once the building block application has assigned identification numbers to each of the available blocks of the set, the memory 208 may also store the identification number (e.g., "1001") for block 200 and the identification numbers of any blocks connected to block 200.

Block Set Data Structures

Figures 3A, 3B:
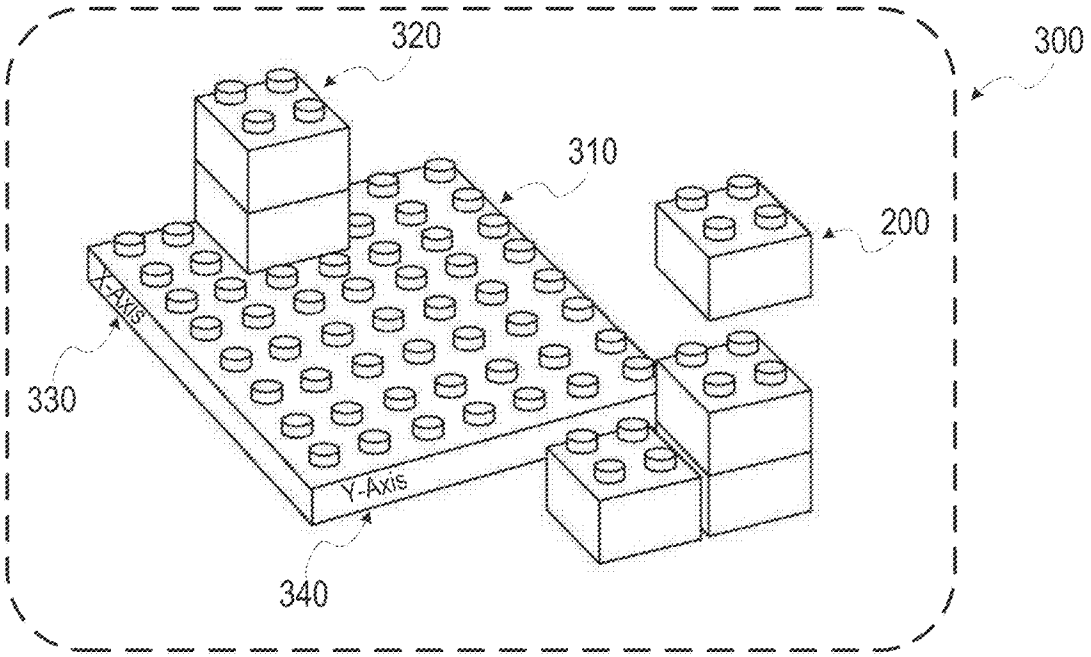
FIG. 3A is a depiction of an example building block set, with a conducting mat upon which to assemble a structure with the blocks of the building block set.
FIG. 3B is an example table including specific information associated with the building blocks of the building block set, including information regarding the position of each block placed on the conducting mat.

FIG. 3A is a depiction of an example building block set 300, with a conducting mat 310 upon which to assemble a structure 320 with the blocks of the building block set 300. The elements in FIG. 3A include elements from FIG. 2, which elements are labeled with the same identifiers.

In some embodiments, electrical power for the wireless communication elements 212, the sensors 202, 204 and 206, the memories 208 and the lighting elements 210 of each respective block 200 of the building block set 300 may be provided by a container for the building block set 300, the conducting mat 310 or another block of the building block set 300 to which said block 200 is connected. As noted above, the container or the conducting mat 310 may provide wireless charging capabilities or more traditional wired charging. Meanwhile the building blocks themselves may also provide electrical power (e.g., from the container or the conducting mat 310) to each other via wired connections established between respective electrical leads of connected blocks. In some embodiments these wired connections between connected blocks may also be used to transmit information between connected blocks, for example, the identification numbers of blocks connected to each other.

As noted above, the conducting mat 310 may be used to identify the location of the building blocks placed at the first level of any building block structure. For example, the conducting mat 310 may include pre-defined x and y axes 330 and 340 for describing the positions of objects (e.g., building blocks) that are placed on the conducting mat 310. In this way, x and y axis ranges may be used to describe the location of the building blocks on the conducting mat 310 regardless of the size or shape of the building block. For example, the position of structure 320 on the conducting mat 310 could be described in x-y coordinates as [(1, 3), (2, 3), (1, 4) and (2, 4)], wherein the connection studs on the conducting mat 310 coincide with the x and y coordinates of the pre-defined x and y axes 330 and 340 of the conducting mat 310.

In some embodiments, the building block application may access, from wireless communication elements 212 in each block (e.g., 200) of the set of blocks 300, general information regarding the set of blocks 300 and specific information regarding at least one block 200 of the set 300 that is placed on a conducting mat 310 and each block of the set that is connected, directly or indirectly, to the at least one block 200 that is on the conducting mat 310. The provision of this building block information to the building block application is described below with respect to FIG. 3B.

FIG. 3B is an example table 350 including specific information associated with the building blocks of the building block set 300, including information regarding the position of each block placed on the conducting mat 310.

In some embodiments, the general information regarding the building block set 300 may include a number of blocks of the set that is of a specific shape (e.g., 25 L-shaped blocks and 15 rectangle shaped blocks) and a number of the blocks of the set of each specific shape that is of a specific color (e.g., 8 L-shaped blocks that are red). This general information regarding the building block set 300 may be accessed from a memory of the container of the building block set or, as described below, by performing calculations on the specific information (e.g., on values in table 350) received from each of the available blocks of the building block set 300.

In some embodiments, each block (e.g., 200) of building block set 300 may be considered a node in a network and once connected (e.g., to the conducting mat or to a block that is connected directly (or indirectly through other blocks) to the conducting mat) the block gets a unique identity number, such as "–1001" for block 200. The first block (e.g., 200) of building block set 300 which is placed on conducting mat 310 will transmit (e.g., via wireless communication element 212) its specific information (e.g., its identification number, shape, color, identification number of other blocks to which it is connected) to the building block application (e.g., running on computing device 115). In the case of the first block, it will not send any block identification numbers (e.g., sends back null values instead) since it is not yet connected to any other blocks of building block set 300 and has not yet been assigned an identification number by the building block application. The building block application will store the specific information of the blocks of building block set 300 for later use, for example, in a table 350 with columns for the "ID NUMBER". "SHAPE". "COLOR". "CONNECTIONS" and "POSITION" of each available block of building block set 300. The first row corresponds to block 200 of FIG. 2 with an assigned identification number "1001", a shape "Shape I" (e.g., square), a color "Color 1" (e.g., blue), connections are blocks with identification numbers "1002 and 1003" and position on (or over as explained below) the conducting mat 310 is "Position 1 (x, y)" which is a function of the coordinates on the X-axis 330 and Y-axis 340 of the conducting mat 310. The "CONNECTIONS" column may only include the identification numbers of blocks that are directly connected to each respective block of the building block set 300.

In some embodiments, the identification numbers of blocks that are indirectly connected to each respective block in the table may be derived by analyzing the specific information of each block that is connected to the respective block and the specific information of any blocks that are connected to the connected blocks and so on recursively to obtain a set of block identification numbers comprising the nodes of the building block structure being assembled on the conducting mat 310.

In some embodiments, the general information regarding the building block set 300 may be calculated based on the specific information accessed from each of the available blocks of building block set 300. For example, the number of square shaped blocks of building block set 300 may be calculated by simply examining the "SHAPE" column of table 350 and adding up the entries for a square shaped block. In a similar manner, the number of green square shaped blocks of building block set 300 may be calculated by simply examining the "SHAPE" column of table 350 and adding up the entries for a square shaped block and then examining these entries and adding up the entries for a green square shaped block (e.g., it could be that no square blocks are green). In this way, the specific information accessed from each block of building block set 300 may be used to generate the general information about how many blocks of each shape are included in the set 300 and how many blocks of each shape are of each color.

In some embodiments, the table 350 may include a "Size" column for each block since, for example, rectangle shaped blocks (e.g., blocks 100 and 110 of FIG. 1) often come in multiple sizes (e.g., measured in the same way that the position of a block on the conducting mat 310 is measured using the X-axis 330 and Y-axis 340). If the blocks of each shape in the building block set are of only one size then the size information for each block of the building block set 300 is not accessed by the building block application and the table 350 does not include a column for the size of each block of the building block set 300.

The building block application may then use the specific information in table 350 and the calculated general information regarding the building block set 301) in accessing structural information about building block structures that may be built on the conducting mat 310 using the blocks of building block set 300. For example, the building block application may consider if there are enough rectangle shaped blocks to build the walls of a castle or if there are enough red rectangle shaped blocks to build the walls of a red castle when it is accessing structural information for structures to be assembled using the available blocks of building block set 300. The building block application may also use the general information and the specific information in table 350 (including the position of each block over the conducting mat 310) and the accessed structural information to generate the process for assembling a user selected structure (selected from structures for which structural information was accessed) with the available blocks of the set 300 and the conducting mat 310. As noted above, in some embodiments the structural information and/or the process may be pre-defined and accessed from a known source (e.g., such as a known database storing such information and processes.

In some embodiments, the building block application may identify the next blocks (e.g., one connected directly or indirectly to the conducting mat 310 and the other not connected to any of the connected blocks) to be connected in a sequence of block to block connections determined by the generated process and transmit instructions for the next blocks to blink their lighting elements (e.g., LED 210) in a matching pattern so that the user will know that these two blocks are to be connected at the blinking lights. When a block (e.g., 200) of building block set 300 is connected to an existing structure (e.g., group of connected blocks over the conducting mat 310) it will become a conducting node and it will send a message including its specific information to the building block application so that the building block application may assign an identification number to the block and learn the identification numbers of blocks to which the block is now connected. The building block application may use the information in the received message to determine whether the user has connected the block according to the instruction of the blinking lights (e.g., the received identification numbers for the connected blocks do not match those that were expected based on the instruction of the blinking lights), if not then the building block application will re-access structural information to conform the structure being assembled on conducting mat 310 to the placement/connection of the blocks by the user.

In some embodiments, if the user mistakenly connects a block to another block in a position that was not indicated by the blinking lights and then removes the erroneously place block, the block becomes a non-conducting node. As with a block that has just been connected, when removed from the structure being assembled on the conducting mat 310, a removed block will pass its specific information to the building block application. This specific information will now lack any identification numbers for connected blocks which serves to inform the building block application that the block now has no connections. When such a disconnection signal is received by the building block application, the building block application will request the specific information from any blocks that were connected to the removed block (e.g., parent nodes) in order to avoid any anomalies with the connection information stored in table 350.

Block Set Physical Structures

Figure 4:
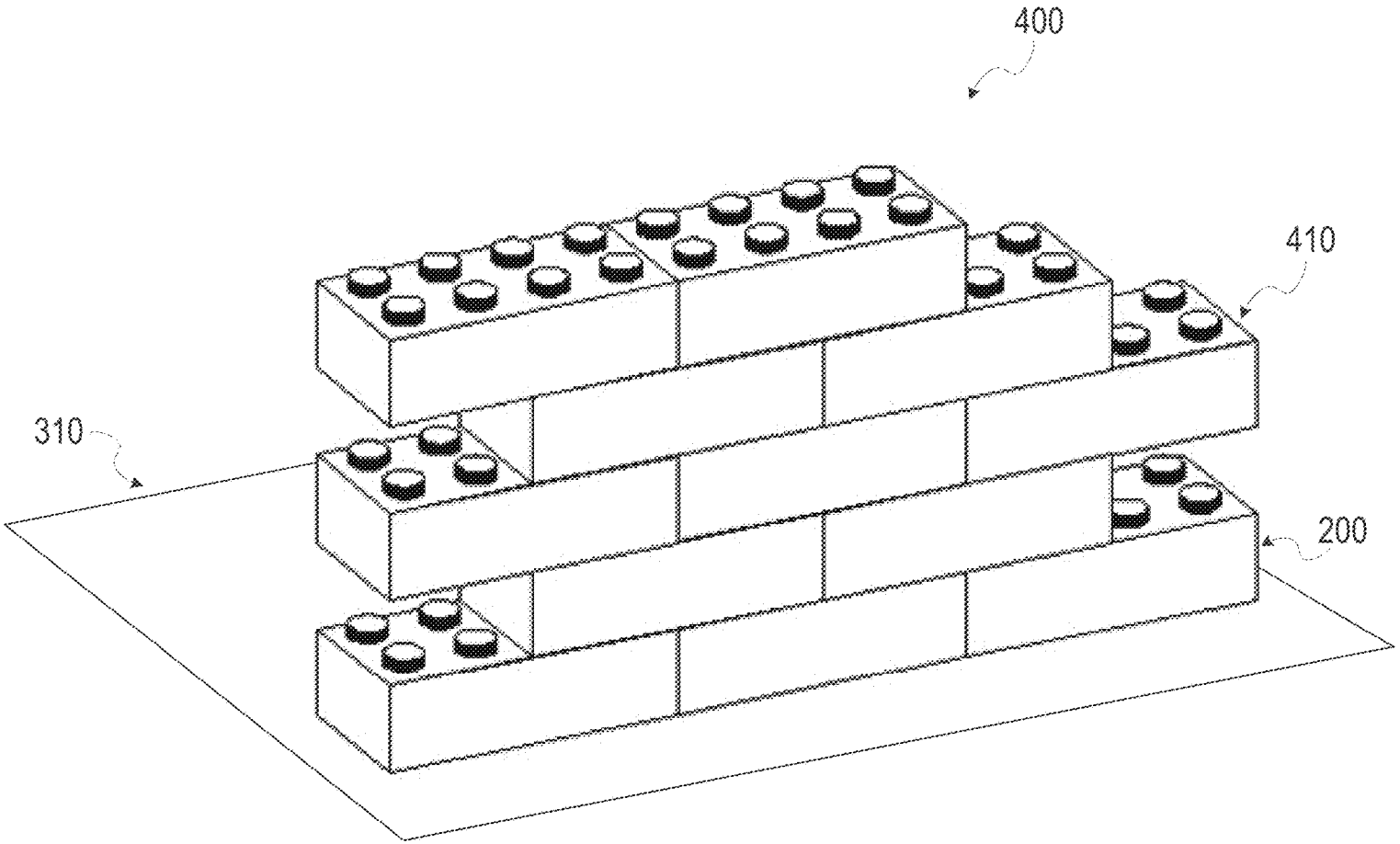
FIG. 4 is a depiction of an example structure assembled on the conducting mat, using the building block set, according to instructions delivered by the lighting elements of each block of the set used to assemble the example structure.

FIG. 4 is a depiction of an example structure 400 assembled on the conducting mat 310, using the building block set 300, according to instructions delivered by the lighting elements of each block 200 of the set 300 used to assemble the example structure 400. The elements in FIG. 4 include elements from FIGS. 2 and 3, which elements are labeled with the same identifiers.

As noted above, the building block application may identify the next blocks (e.g., one connected directly or indirectly to the conducting mat 310 and the other not connected to any of the connected blocks) to be connected in a sequence of block to block connections determined by the generated process and transmit instructions for the next blocks to blink their lighting elements (e.g., LED 210) in a matching pattern so that the user will know that these two blocks are to be connected at the locations of the blinking lights. As the user progresses through the sequence of block to block connections outlined by the generated process a structure 400 begins to form on the conducting mat 310. The blocks (e.g., block 200) placed directly on the conducting mat 310 are considered to be the first level of the structure 400 and blocks (e.g., block 410) that are connected to these blocks are considered to form the second level of the structure 400 and so on for any higher levels of the structure 400.

In some embodiments, the position of the blocks at the higher levels of the structure 400 (e.g., level>1) may be described in a similar manner to those at the first level of the structure (e.g., x and y coordinates with respect to the conducting mat 310). For example, the building block application may determine the position of a block 410 at a third level of the structure 400 to have a position described as having the same x and y coordinates of the block 200) with respect to X-axis 330 and Y-axis 340 of conducting mat 310 with an added value for the "level" of the structure which block 410 occupies. In the example of FIG. 4 the level of block 410 would be level 3. The building block application may use the building block identification number based block to block connection information (e.g., "1002 and 1003" for block 200) for the blocks of structure 400) to determine the position of the block 410 over the conducting mat 310.

In some embodiments, the user may refuse to connect the blocks that are indicated for connection by their respective blinking lighting elements, and instead connects a block of the block set 304) that is not blinking its lights to the connected blocks of the structure 400 being assembled on conducting mat 310. As noted above, in this situation, the building application will attempt to re-access structural information for possible building block structures to be built based on the new combination of connected blocks resulting from the user's choice to connect a block that was not indicated for connection according to the process of the structure 400 that had been previously selected for assembly using the building block set 300.

Furthermore, in this situation, the building block application will monitor the balance and stability of such a dynamic creation of a new structure 400 according to the user variation from the suggested block placement of the process for assembling the structure 400 with the available blocks of the building block set 300. If the building block application detects an imbalance (e.g., greater than a threshold variation in center of gravity) in the structure 400 after the user's connection of a block to structure 400, the building block application may trigger a solid (e.g., continuous, non-blinking) red light (e.g., via LED 210) at the offending block and beep (e.g., via a speaker of computing device 115) to indicate to the user that the block is compromising the balance/stability of the structure 400 on the conducting mat 310.

In some embodiments, the building block application may monitor the circumference or the perimeter of the structure 400 to ensure that if becomes smaller as the structure 400 rises (e.g., accrues more levels) or alternatively at least remains the same as the structure 400 rises. This limitation of the structure 400 to only rise with a gradually descending diameter or perimeter helps lessen the burden of the base (e.g., level 1 of structure 400) because each lower level of structure 400 is built bigger (or at least equal) to the levels above it so that the below part may support the weight of the upper part. The building block application may run such a balance/stability determination algorithm in the background and may at each new level of structure 400 evaluate the balance and/or stability of structure 400 and provide feedback.

In some embodiments, the balance/stability determination algorithm may check the diameter/perimeter of a higher level of the structure 400 against multiple lower levels of the structure 400 so that even if the immediately lower level has a smaller diameter/perimeter than the newest level, this may not trigger any warnings with respect to balance or stability because a level further down (e.g., less than a threshold value of levels lower) does have a larger base and the size of the new levels diameter/perimeter does not threaten the balance/stability of structure 400 because of this. For example, the $3^{rd}$ level of structure 400 (e.g., level of block 410) has a larger perimeter than the immediately lower $2^{nd}$ level. However, since the further down level 1 (e.g., level of block 200) has a perimeter that is at least as big (e.g., equal in this case) as the perimeter of level 3, the balance/stability determination algorithm of the building block application may not consider the balance and/or stability of structure 400 to be compromised by the size of the perimeter of level 3 of structure 400.

Methods

Figure 5:
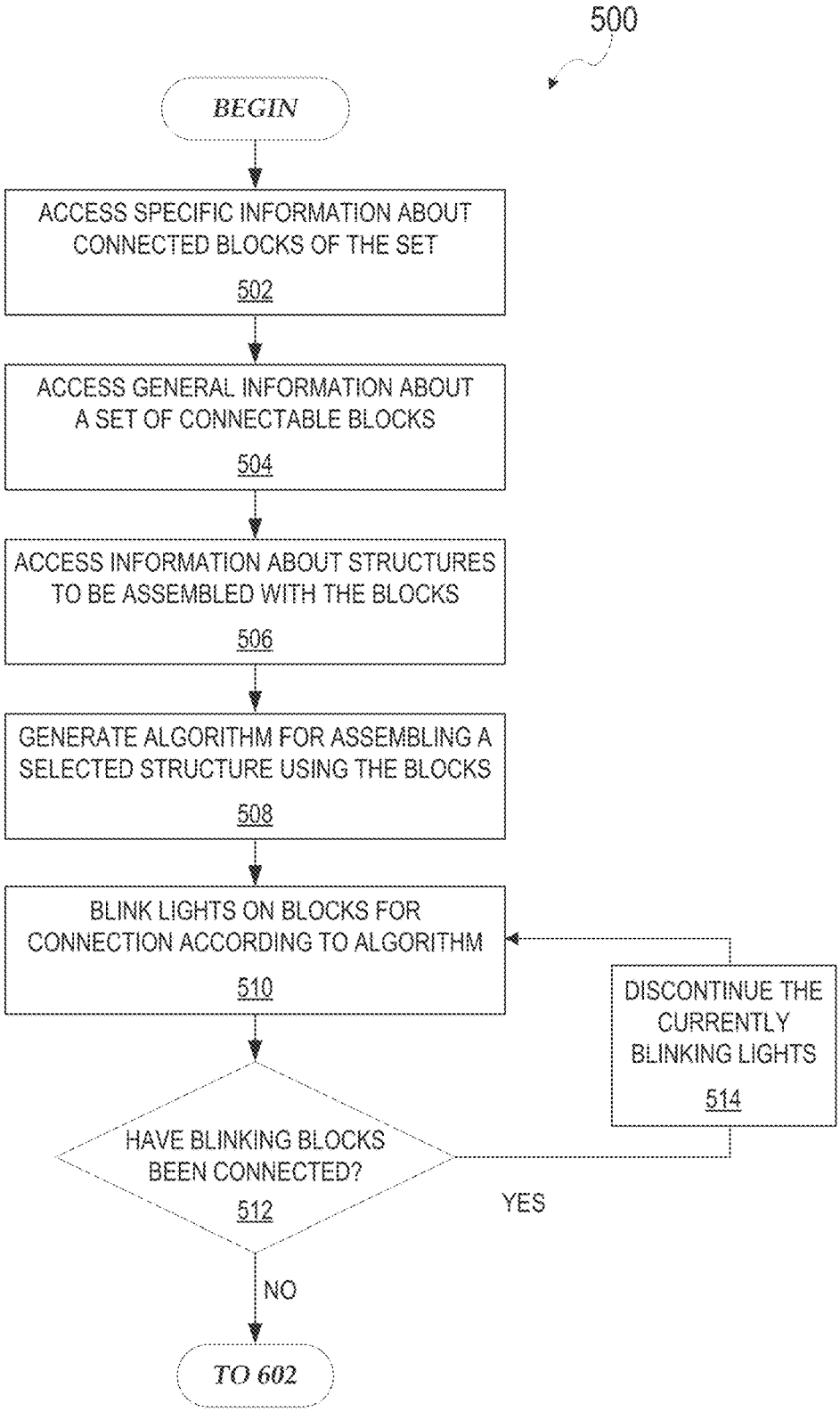
FIG. 5 is a flow diagram illustrating a method, consistent with some embodiments, for blinking the lights of building blocks of the building block set to indicate step by step instructions for connecting the blocks to assemble a structure on the conducting mat.

FIG. 5 is a flow diagram illustrating a method 500, consistent with some embodiments, for blinking the lights of building blocks 200 of the building block set 300 to indicate step by step instructions for connecting the blocks 200 to assemble a structure on the conducting mat 310. The operations of method 500 are described with respect to the elements of FIGS. 1-4, as described above.

At operation 502, the building block application may access, from wireless communication elements (e.g., 212) in each block (e.g., 200) of the set of blocks (e.g., 300), specific information (e.g., identification numbers of connected blocks) regarding at least one block of the set 300 that is placed on a conducting mat 310 and each block of the set 300 that is connected, directly or indirectly, to the at least one block on the conducting mat 310. As noted above, the identification numbers of blocks that are indirectly connected to each respective block in the table 350 (e.g., of the building block application) may be derived by analyzing the specific information of each block (e.g., 200) that is connected to the respective block and the specific information of any blocks that are connected to the connected blocks and so on recursively to obtain a set of block identification numbers comprising the nodes of the building block structure 400 being assembled on the conducting mat 310.

At operation 504, access, from wireless communication elements (e.g., 212) in each block (e.g., 200) of the set of blocks (e.g., 300), general information (e.g., number of blocks of a specific shape) regarding the set of blocks 300. As noted above, the general information regarding the building block set 300 may be calculated based on the specific information accessed from each of the available blocks (e.g., 200) of building block set 300. For example, the number of square shaped blocks of building block set 300 may be calculated by simply examining the "SHAPE" column of table 350 and adding up the entries for a square shaped block. In this way, the specific information accessed from each block of building block set 300 may be used by the building block application to generate the general information about the blocks of the building block set 300.

At operation 506, based on the general information and the specific information, the building block application may access structural information regarding physical structures for assembly using the set of blocks 300. As noted above, the structural information (e.g., shapes, heights, widths, lengths, etc.) of possible physical structures to be modeled using the building blocks of the set 300 may be accessed from a known location (e.g., database of pre-defined structures) or via a search over a network such as the internet.

At operation 508, the building block application receives a selection of one of the structures (e.g., via a user interface shown on computing device 115) and generate (or access from a known location) a process for assembling the selected structure 400 on the conducting mat 310 by connecting specified blocks of the building block set 300 in an ordered sequence of connections. The process may be based on the general and specific information regarding the available blocks of building block set 300 and the structural information associated with the selected structure.

At operation 510, the building block application identifies the next blocks (e.g., one connected directly or indirectly to the conducting mat 310 and the other not connected to any of the connected blocks) to be connected in a sequence of block to block connections determined by the generated process and transmit instructions for the next blocks to blink their lighting elements (e.g., LED 210) in a matching pattern. The blinking lights signal to the user that these two blocks are to be connected at the locations of the blinking lights in order to assemble the selected structure 400 on the conducting mat 310.

At operation 512, the building block application determines whether the at least one block of the set 300 that is not connected to any other block been connected to the at least one block or one of the blocks to which the at least one block is connected. If the connection has been made, the method 500 continues to operation 514 as described below. If the connection has not been made, the method 500 continues to operation 602 of method 600 of FIG. 6 as described below.

At operation 514, the building block application may cause the system to stop the lighting elements from blinking based on the at least one block of the set that is not connected to any other block being connected to the at least one block or one of the blocks to which the at least one block is connected. The method 500 then returns to operation 510 in order to cause the lighting elements of the next blocks of the set 300 to be connected according to the generated process for assembling the selected structure 400 on the conducting mat 310.

Figure 6:
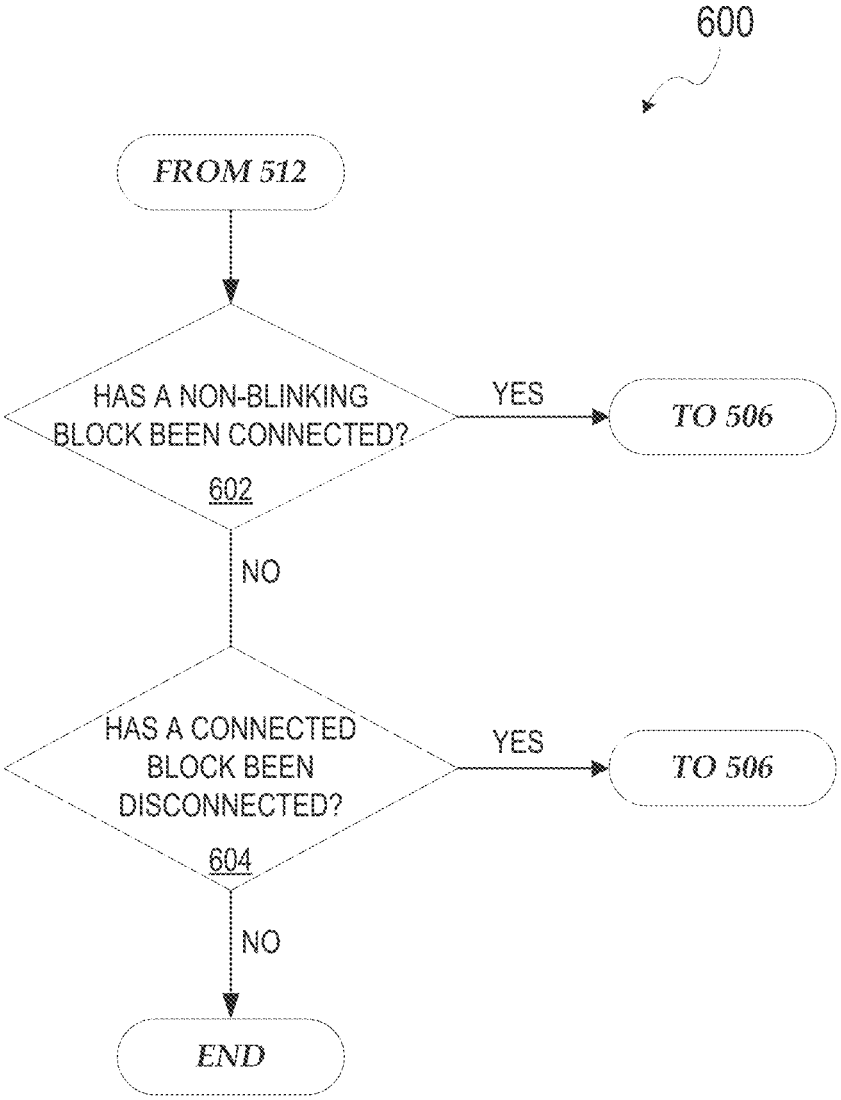
FIG. 6 is a flow diagram illustrating a method, consistent with some embodiments, for dynamically accessing structural information of structures for assembly using building blocks of the building block set based on the block to block connections made by a user.

FIG. 6 is a flow diagram illustrating a method 600, consistent with some embodiments, for dynamically accessing structural information of structures for assembly using building blocks 200 of the building block set 300 based on the block to block connections made by a user. The operations of method 600 are described with respect to the elements of FIGS. 1-4, as described above.

At operation 602 (which continues from operation 512 of method 500 of FIG. 5 described above), the building block application determines whether at least one block of the set 300 without a blinking lighting element (e.g., LED 210) has been connected to the at least one block (on the conducting mat 310) or one of the blocks to which the at least one block is connected. If the connection has not been made, the method 600 continues to operation 604 as described below. If the connection has been made, the method 600 continues to operation 506 of method 500 of FIG. 5 as described above to re-access the structural information. In this way, the building block application may adapt the structures suggested for assembly to the user's connection of blocks.

At operation 604, the building block application determines whether the at least one block (on the conducting mat 310) or one of the blocks to which the at least one block is connected has been disconnected from at least one connected block. If the disconnection has not been made, the method 600 ends. If the disconnection has been made, the method 600 continues to operation 506 of method 500 of FIG. 5 as described above to re-access the structural information. In this way the building block application may adapt the structures suggested for assembly to the user's disconnection of blocks.

Figure 7:
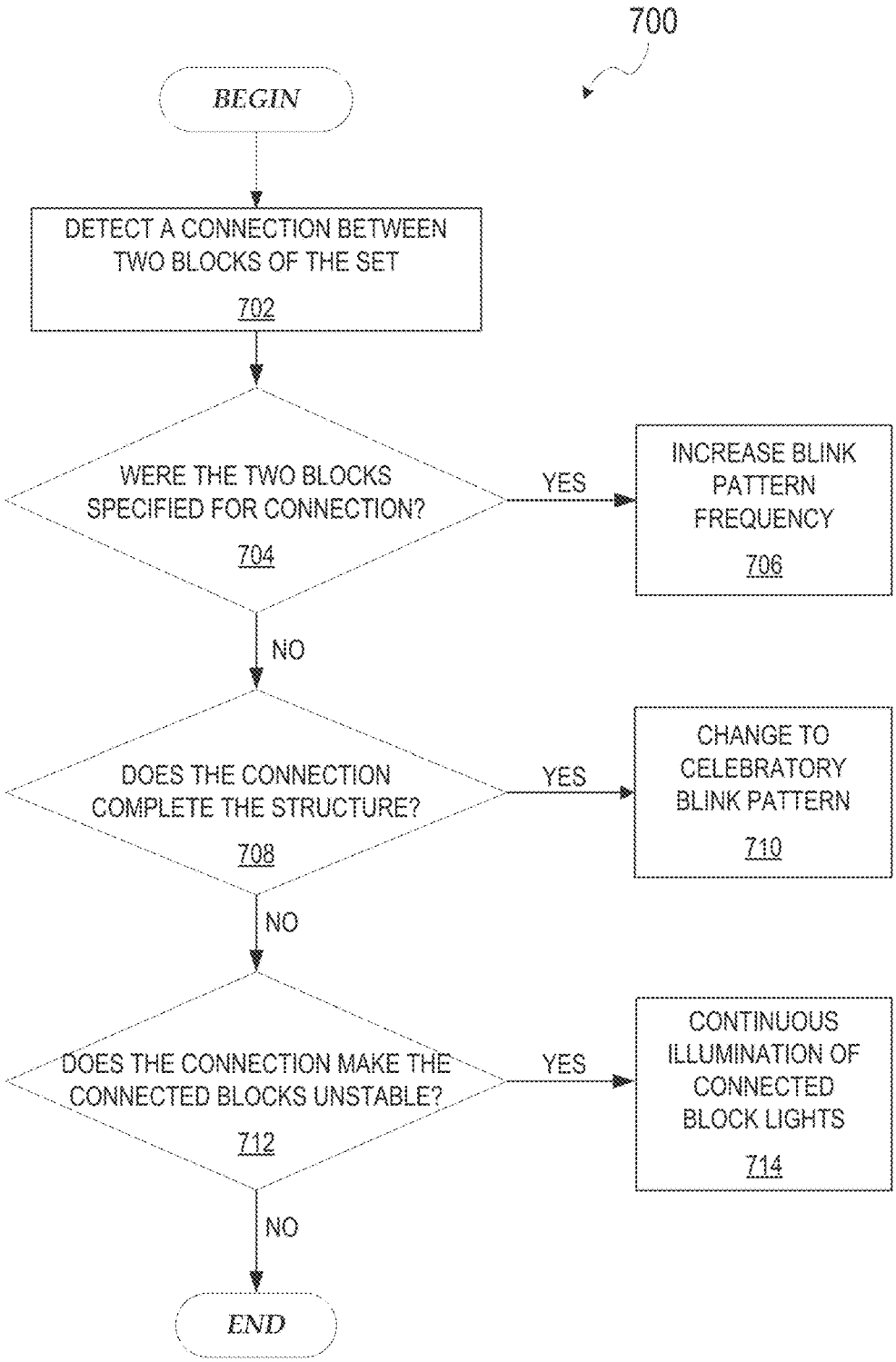
FIG. 7 is a flow diagram illustrating a method, consistent with some embodiments, for dynamically modifying a pattern of blinking lights of building blocks of the building block set based on the block to block connections made by a user.

FIG. 7 is a flow diagram illustrating a method 700, consistent with some embodiments, for dynamically modifying a pattern of blinking lights of building blocks 200 of the building block set 300 based on the block to block connections made by a user. The operations of method 700 are described with respect to the elements of FIGS. 1-4, as described above.

At operation 702, the building block application may detect a connection between two blocks (e.g., 100) and 110) of the set 300. For example, by receiving identification numbers for blocks that have become connected as described with respect to table 350 of FIG. 3B.

At operation 704, the building block application may determine whether the connected blocks were specified (e.g., via blinking lighting elements A and B) for connection in the sequence of ordered connections outlined by the generated process for assembling the selected structure 400 on the conducting mat 310. If the blocks were not specified for connection, the method 700 continues to operation 708 as described below. If the blocks were specified for connection, the method 700 continues to operation 706 as described below.

At operation 706, the building block application may cause the blinking lighting elements (e.g., A and B) to blink at an increased frequency in response to the connection of the two blocks to indicate that an increasing number of the blocks (e.g., specified by the process for connection according to the sequence) are becoming connected to each other.

At operation 708, the building block application may determine whether the connected blocks are the last two block specified for connection by the sequence of connections according to the process for assembling structure 400 on the conducting mat 310. If the blocks were not the last two blocks specified for connection, the method 700 continues to operation 712 as described below. If the blocks were the last two blocks specified for connection, the method 700 continues to operation 710 as described below.

At operation 710, the building block application may cause the blinking lighting elements (e.g., A and B) to blink in a celebratory pattern to indicate that the structure 400 has been completed on the conducting mat 310. As noted above, a celebratory pattern of blinking lights may comprise a fast (e.g., above a threshold value) alternating sequence of differently colored lights around the perimeter of the structure or other such patterns of blinking lights (e.g., bright colors only).

At operation 712, the building block application may determine whether the connected blocks compromise the stability and/or balance of the structure 400 on the conducting mat 310. If the connection of the blocks does not compromise the stability and/or balance of the structure 400 on the conducting mat 310, the method 700 ends. If the connection of the blocks does compromise the stability and/or balance of the structure 400 on the conducting mat 310, the method 700 continues to operation 714 as described below.

At operation 714, the building block application may cause the blinking lighting elements (e.g., A and B) to blink in a solid pattern (e.g., solid red light) to indicate that the balance/stability of the structure 400 has been compromised by the connection of the two blocks. As noted above, the building block application may also issue audio cues (e.g., beeps or alarm sounds) to indicate that the stability and/or balance of the structure 400 on the conducting mat 310 has been compromised.

Modules, Components, and Logic

Certain embodiments are described herein as including logic or a number of components, modules, or mechanisms. Modules may constitute either software modules (e.g., code embodied on a machine-readable medium) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a Field-Programmable Gate Array (FPGA) or an Application Specific Integrated Circuit (ASIC). A hardware module may also include programmable logic or circuitry that is temporarily configured by software to perform certain operations. For example, a hardware module may include software executed by a general-purpose processor or other programmable processor. Once configured by such software, hardware modules become specific machines (or specific components of a machine) uniquely tailored to perform the configured functions and are no longer general-purpose processors. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software accordingly configures a particular processor or processors, for example, to constitute a particular hardware module at one instance of time and to constitute a different hardware module at a different instance of time.

Hardware modules may provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and may operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, with a particular processor or processors being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application programming interface (API)).

The performance of certain of the operations may be distributed among the processors, not only residing within a single machine, but deployed across a number of machines. In some example embodiments, the processors or processor-implemented modules may be located in a single geographic location (e.g., within a home environment, an office environment, or a server farm). In other example embodiments, the processors or processor-implemented modules may be distributed across a number of geographic locations.

Machine and Software Architecture

Figure 8:
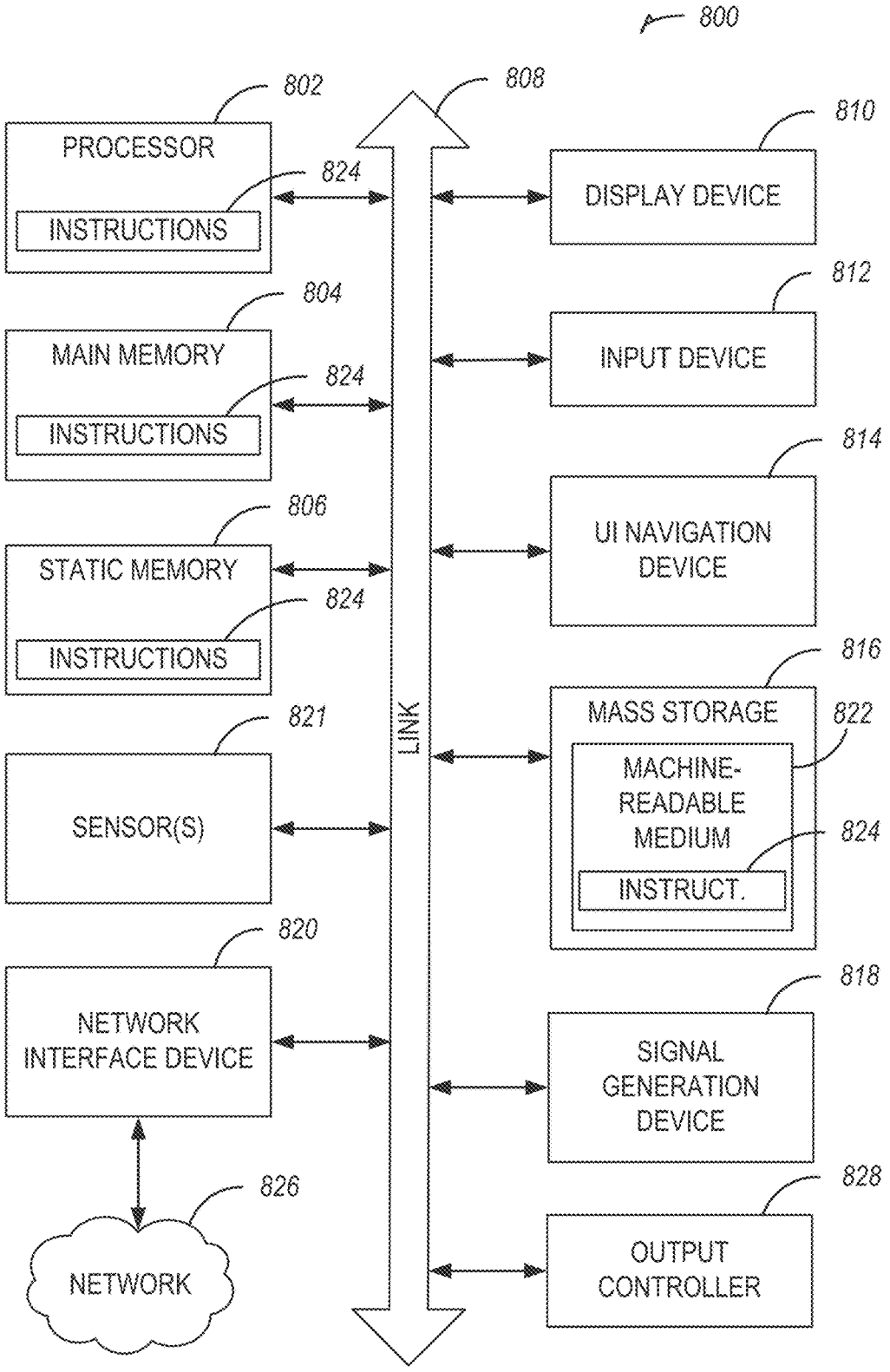
FIG. 8 is a block diagram illustrating a machine in the example form of a computer system 800, within which a set or sequence of instructions may be executed to cause the machine to perform any one of the methodologies discussed herein, according to an example embodiment.

FIG. 8 is a block diagram illustrating a machine in the example form of a computer system 800, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, wearable device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 800 includes at least one processor 802 (e.g., a central processing unit (CPU), a graphics processing unit (GPU) or both, processor cores, compute nodes, etc.), a main memory 804 and a static memory 806, which communicate with each other via a link 808 (e.g., bus). The computer system 800 may further include a video display unit 810, an alphanumeric input device 812 (e.g., a keyboard), and a user interface (UI) navigation device 814 (e.g., a mouse). In one embodiment, the video display unit 810, input device 812 and UI navigation device 814 are incorporated into a touch screen display. The computer system 800 may additionally include a storage device 816 (e.g., a drive unit), a signal generation device 818 (e.g., a speaker), a network interface device 820, and one or more sensors (not shown), such as a global positioning system (GPS) sensor, compass, accelerometer, gyrometer, magnetometer, or other sensor.

The storage device 816 includes a machine-readable medium 822 on which is stored one or more sets of data structures and instructions 824 (e.g., software) embodying or utilized by any one or more of the methodologies or functions described herein. The instructions 824 may also reside, completely or at least partially, within the main memory 804, static memory 806, and/or within the processor 802 during execution thereof by the computer system 800, with the main memory 804, static memory 806, and the processor 802 also constituting machine-readable media.

While the machine-readable medium 822 is illustrated in an example embodiment to be a single medium, the term "machine-readable medium" may include a single medium or multiple media (e.g., a centralized or distributed database, and/or associated caches and servers) that store the one or more instructions 824. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include volatile or non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 824 may further be transmitted or received over a communications network 826 using a transmission medium via the network interface device 820 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

Examples, as described herein, may include, or may operate on, logic or a number of components, modules, or mechanisms. Modules may be hardware, software, or firmware communicatively coupled to one or more processors in order to carry out the operations described herein. Modules may be hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Additional Notes & Examples

Example 1 is a system for assembling a set of connectable building blocks, the system comprising: a processor and machine-readable media coupled to the processor, the machine-readable media comprising instructions which, when executed by the processor, cause the system to: access, from wireless communication elements in each block of the set of blocks, general information regarding the set of blocks and specific information regarding at least one block of the set that is placed on a conducting mat and each block of the set that is connected to the at least one block on the conducting mat; based on the general information and the specific information, access structural information regarding physical structures for assembly using the set of blocks; receive a selection of one of the structures and generate a process for building the selected structure using the set of blocks, the process based on the general and specific information and the structural information associated with the selected structure; and cause a lighting element of the at least one block or one of the blocks to which it is connected to blink based on the process and cause a lighting element of at least one block of the set that is not connected to any other block of the set to blink based on the process.

In Example 2, the subject matter of Example 1 optionally includes the machine-readable media further comprising instructions which, when executed by the processor, cause the system to stop the lighting elements from blinking based on the at least one block of the set that is not connected to any other block being connected to the at least one block or one of the blocks to which the at least one block is connected.

In Example 3, the subject matter of any one or more of Examples 1-2 optionally include wherein the structural information is accessed from a database of pre-defined physical structures for assembly using the set of blocks or from sources available via a network connection.

In Example 4, the subject matter of any one or more of Examples 1-3 optionally include the machine-readable media further comprising instructions which, when executed by the processor, cause the system to re-access the structural information based on at least one block of the set without a blinking lighting element being connected to the at least one block or one of the blocks to which the at least one block is connected.

In Example 5, the subject matter of Example 4 optionally includes the machine-readable media further comprising instructions which, when executed by the processor, cause the system to: evaluate the stability of the connected blocks, and set the lighting element of the at least one block of the set without a blinking lighting element to be continuously illuminated as a warning that the connected blocks are being made unstable based on the connection of the at least one block of the set without a blinking lighting element.

In Example 6, the subject matter of any one or more of Examples 1-5 optionally include the machine-readable media further comprising instructions which, when executed by the processor, cause the system to re-access the structural information based on the at least one block or one of the blocks to which the at least one block is connected being disconnected from at least one connected block.

In Example 7, the subject matter of any one or more of Examples 1-6 optionally include wherein the general information comprises a number of blocks of the set that is of a specific shape and a number of the blocks of the set of each specific shape that is of a specific color.

In Example 8, the subject matter of Example 7 optionally includes wherein the specific information comprises at least one of: an assigned identification number, assigned identification numbers of the blocks to which it is connected, a position with respect to the conducting mat and the building blocks to which it is connected, a shape, or a color.

In Example 9, the subject matter of Example 8 optionally includes wherein the specific information is stored in a respective memory of each block of the set, and wherein the machine-readable media further comprises instructions which, when executed by the processor, cause the system to determine the general information regarding the set of blocks based on the specific information of each block of the set.

In Example 10, the subject matter of Example 9 optionally includes wherein each block of the set includes sound, light, and proximity sensors, and wherein the specific information for a block of the set is not accessed based on the sound or light sensors detecting sound or light below respective sound or light threshold values or the proximity sensor not detecting any objects within a threshold distance.

In Example 11, the subject matter of Example 10 optionally includes wherein electrical power for the wireless communication elements, the memories, the sensors, and the lighting elements of each respective block of the set is provided by: a container for the set of blocks, the conducting mat, or another block of the set to which said respective block is connected.

In Example 12, the subject matter of any one or more of Examples 1-11 optionally include wherein the wireless communication elements comprise Bluetooth, NFC, Wi-Fi, or radio communication elements.

In Example 13, the subject matter of any one or more of Examples 1-12 optionally include wherein the lighting element of each respective block of the set includes an LEE) light of a specified color based on a color of the respective block of the set.

In Example 14, the subject matter of any one or more of Examples 1-13 optionally include wherein the process defines a sequence of connections between specified blocks of the set in order to assemble the selected structure on the conducting mat.

In Example 15, the subject matter of Example 14 optionally includes wherein the blinking lighting elements blink in a specified pattern and wherein the frequency of the pattern increases as more of the specified blocks are connected according to the sequence.

Example 16 is a method for assembling a set of connectable building blocks, the method comprising: accessing, from wireless communication elements in each block of the set of blocks, general information regarding the set of blocks and specific information regarding at least one block of the set that is placed on a conducting mat and each block of the set that is connected to the at least one block on the conducting mat; based on the general information and the specific information, accessing structural information regarding physical structures for assembly using the set of blocks; receiving a selection of one of the structures and generating a process for building the selected structure using the set of blocks, the process based on the general and specific information and the structural information associated with the selected structure; and causing a lighting element of the at least one block or one of the blocks to which it is connected to blink based on the process and causing a lighting element of at least one block of the set that is not connected to any other block of the set to blink based on the process.

In Example 17, the subject matter of Example 16 optionally includes stopping the lighting elements from blinking based on the at least one block of the set that is not connected to any other block being connected to the at least one block or one of the blocks to which the at least one block is connected.

In Example 18, the subject matter of any one or more of Examples 16-17 optionally include wherein the structural information is accessed from a database of pre-defined physical structures for assembly using the set of blocks or from sources available via a network connection.

In Example 19, the subject matter of any one or more of Examples 16-18 optionally include re-accessing the structural information based on at least one block of the set without a blinking lighting element being connected to the at least one block or one of the blocks to which the at least one block is connected.

In Example 20, the subject matter of Example 19 optionally includes evaluating the stability of the connected blocks and setting the lighting element of the at least one block of the set without a blinking lighting element to be continuously illuminated as a warning that the connected blocks are being made unstable based on the connection of the at least one block of the set without a blinking lighting element.

In Example 21, the subject matter of any one or more of Examples 16-20 optionally include re-accessing the structural information based on the at least one block or one of the blocks to which the at least one block is connected being disconnected from at least one connected block.

In Example 22, the subject matter of any one or more of Examples 16-21 optionally include wherein the general information comprises a number of blocks of the set that is of a specific shape and a number of the blocks of the set of each specific shape that is of a specific color.

In Example 23, the subject matter of Example 22 optionally includes wherein the specific information comprises at least one of an assigned identification number, assigned identification numbers of the blocks to which it is connected, a position with respect to the conducting mat and the building blocks to which it is connected, a shape, or a color.

In Example 24, the subject matter of Example 23 optionally includes wherein the specific information is stored in a respective memory of each block of the set and the general information regarding the set of blocks is determined based on the specific information of each block of the set.

In Example 25, the subject matter of Example 24 optionally includes wherein each block of the set includes sound, light, and proximity sensors, and wherein the specific information for a block of the set is not accessed based on the sound or light sensors detecting sound or light below respective sound or light threshold values or the proximity sensor not detecting any objects within a threshold distance.

In Example 26, the subject matter of Example 25 optionally includes wherein electrical power for the wireless communication elements, the memories, the sensors, and the lighting elements of each respective block of the set is provided by: a container for the set of blocks, the conducting mat, or another block of the set to which said respective block is connected.

In Example 27, the subject matter of any one or more of Examples 16-26 optionally include wherein the wireless communication elements comprise Bluetooth, NFC. Wi-Fi or radio communication elements.

In Example 28, the subject matter of any one or more of Examples 16-27 optionally include wherein the lighting element of each respective block of the set includes an LED light of a specified color based on a color of the respective block of the set.

In Example 29, the subject matter of any one or more of Examples 16-28 optionally include wherein the process defines a sequence of connections between specified blocks of the set in order to assemble the selected structure on the conducting mat.

In Example 30, the subject matter of Example 29 optionally includes wherein the blinking lighting elements blink in a specified pattern and wherein the frequency of the pattern increases as more of the specified blocks are connected according to the sequence.

Example 31 is at least one machine-readable medium including instructions, which when executed by a machine, cause the machine to perform operations of any of the methods of Examples 16-30.

Example 32 is an apparatus comprising means for performing any of the methods of Examples 16-30.

Example 33 is an apparatus for assembling a set of connectable building blocks, the apparatus comprising: means for accessing, from wireless communication elements in each block of the set of blocks, general information regarding the set of blocks and specific information regarding at least one block of the set that is placed on a conducting mat and each block of the set that is connected to the at least one block on the conducting mat; means for accessing, based on the general information and the specific information, structural information regarding physical structures for assembly using the set of blocks; means for receiving a selection of one of the structures and means for generating a process for building the selected structure using the set of blocks, the process based on the general and specific information and the structural information associated with the selected structure; and means for causing a lighting element of the at least one block or one of the blocks to which it is connected to blink based on the process and causing a lighting element of at least one block of the set that is not connected to any other block of the set to blink based on the process.

In Example 34, the subject matter of Example 33 optionally includes means for stopping the lighting elements from blinking based on the at least one block of the set that is not connected to any other block being connected to the at least one block or one of the blocks to which the at least one block is connected.

In Example 35, the subject matter of any one or more of Examples 33-34 optionally include means for accessing the structural information from a database of pre-defined physical structures for assembly using the set of blocks or from sources available via a network connection.

In Example 36, the subject matter of any one or more of Examples 33-35 optionally include means for re-accessing the structural information based on at least one block of the set without a blinking lighting element being connected to the at least one block or one of the blocks to which the at least one block is connected.

In Example 37, the subject matter of Example 36 optionally includes means for evaluating the stability of the connected blocks and setting the lighting element of the at least one block of the set without a blinking lighting element to be continuously illuminated as a warning that the connected blocks are being made unstable based on the connection of the at least one block of the set without a blinking lighting element.

In Example 38, the subject matter of any one or more of Examples 33-37 optionally include means for re-accessing the structural information based on the at least one block or one of the blocks to which the at least one block is connected being disconnected from at least one connected block.

In Example 39, the subject matter of any one or more of Examples 33-38 optionally include wherein the general information comprises a number of blocks of the set that is of a specific shape and a number of the blocks of the set of each specific shape that is of a specific color.

In Example 40, the subject matter of Example 39 optionally includes wherein the specific information comprises at least one of: an assigned identification number, assigned identification numbers of the blocks to which it is connected, a position with respect to the conducting mat and the building blocks to which it is connected, a shape, or a color.

In Example 41, the subject matter of Example 40 optionally includes means for storing the specific information in a respective memory of each block of the set and means for determining the general information regarding the set of blocks based on the specific information of each block of the set.

In Example 42, the subject matter of Example 41 optionally includes wherein each block of the set includes sound, light, and proximity sensors, and wherein the apparatus further comprises means for excluding the specific information for a block of the set from being accessed based on the sound or light sensors detecting sound or light below respective sound or light threshold values or the proximity sensor not detecting any objects within a threshold distance.

In Example 43, the subject matter of Example 42 optionally includes means for providing electrical power to the wireless communication elements, the memories, the sensors and the lighting elements of each respective block of the set from: a container for the set of blocks, the conducting mat or another block of the set to which said respective block is connected.

In Example 44, the subject matter of any one or more of Examples 33-43 optionally include wherein the wireless communication elements comprise Bluetooth, NFC, Wi-Fi or radio communication elements.

In Example 45, the subject matter of any one or more of Examples 33-44 optionally include wherein the lighting element of each respective block of the set includes LED means of a specified color based on a color of the respective block of the set.

In Example 46, the subject matter of any one or more of Examples 33-45 optionally include wherein the process defines a sequence of connections between specified blocks of the set in order to assemble the selected structure on the conducting mat.

In Example 47, the subject matter of Example 46 optionally includes means for causing the blinking lighting elements to blink in a specified pattern and means for causing the frequency of the pattern to increase as more of the specified blocks are connected according to the sequence.

Example 48 is at least one non-transitory machine-readable storage medium comprising instructions which, when executed by a processor of a machine, cause the machine to, access, from wireless communication elements in each block of the set of blocks, general information regarding the set of blocks and specific information regarding at least one block of the set that is placed on a conducting mat and each block of the set that is connected to the at least one block on the conducting mat; based on the general information and the specific information, access structural information regarding physical structures for assembly using the set of blocks; receive a selection of one of the structures and generate a process for building the selected structure using the set of blocks, the process based on the general and specific information and the structural information associated with the selected structure; and cause a lighting element of the at least one block or one of the blocks to which it is connected to blink based on the process and cause a lighting element of at least one block of the set that is not connected to any other block of the set to blink based on the process.

In Example 49, the subject matter of Example 48 optionally includes instructions which, when executed by a processor of the machine, cause the machine to stop the lighting elements from blinking based on the at least one block of the set that is not connected to any other block being connected to the at least one block or one of the blocks to which the at least one block is connected.

In Example 50, the subject matter of any one or more of Examples 48-49 optionally include wherein the structural information is accessed from a database of pre-defined physical structures for assembly using the set of blocks or from sources available via a network connection.

In Example 51, the subject matter of any one or more of Examples 48-50 optionally include instructions which, when executed by a processor of the machine, cause the machine to re-access the structural information based on at least one block of the set without a blinking lighting element being connected to the at least one block or one of the blocks to which the at least one block is connected.

In Example 52, the subject matter of Example 51 optionally includes instructions which, when executed by a processor of the machine, cause the machine to: evaluate the stability of the connected blocks, and set the lighting element of the at least one block of the set without a blinking lighting element to be continuously illuminated as a warning that the connected blocks are being made unstable based on the connection of the at least one block of the set without a blinking lighting element.

In Example 53, the subject matter of any one or more of Examples 48-52 optionally include instructions which, when executed by a processor of the machine, cause the machine to re-access the structural information based on the at least one block or one of the blocks to which the at least one block is connected being disconnected from at least one connected block.

In Example 54, the subject matter of any one or more of Examples 48-53 optionally include wherein the general information comprises a number of blocks of the set that is of a specific shape and a number of the blocks of the set of each specific shape that is of a specific color.

In Example 55, the subject matter of Example 54 optionally includes wherein the specific information comprises at least one of: an assigned identification number, assigned identification numbers of the blocks to which it is connected, a position with respect to the conducting mat and the building blocks to which it is connected, a shape, or a color.

In Example 56, the subject matter of Example 55 optionally includes the specific information is stored in a respective memory of each block of the set, and wherein the machine-readable storage medium comprises instructions which, when executed by a processor of the machine, cause the machine to: determine the general information regarding the set of blocks based on the specific information of each block of the set.

In Example 57, the subject matter of Example 56 optionally includes wherein each block of the set includes sound, light, and proximity sensors, and wherein the machine-readable storage medium comprises instructions which, when executed by a processor of the machine, cause the machine to: exclude the specific information for a block of the set from being accessed based on the sound or light sensors detecting sound or light below respective sound or light threshold values or the proximity sensor not detecting any objects within a threshold distance.

In Example 58, the subject matter of Example 57 optionally includes wherein electrical power for the wireless communication elements, the memories, the sensors, and the lighting elements of each respective block of the set is provided by: a container for the set of blocks, the conducting mat, or another block of the set to which said respective block is connected.

In Example 59, the subject matter of any one or more of Examples 48-58 optionally include wherein the wireless communication elements comprise Bluetooth, NFC, Wi-Fi or radio communication elements.

In Example 60, the subject matter of any one or more of Examples 48-59 optionally include wherein the lighting element of each respective block of the set includes an LED light of a specified color based on a color of the respective block of the set.

In Example 61, the subject matter of any one or more of Examples 48-60 optionally include wherein the process defines a sequence of connections between specified blocks of the set in order to assemble the selected structure on the conducting mat.

In Example 62, the subject matter of Example 61 optionally includes wherein the blinking lighting elements blink in a specified pattern and wherein the frequency of the pattern increases as more of the specified blocks are connected according to the sequence.

Example 63 is at least one machine-readable medium including instructions, which when executed by a machine, cause the machine to perform operations of any of the operations of Examples 1-62.

Example 64 is an apparatus comprising means for performing any of the operations of Examples 1-62.

Example 65 is a system to perform the operations of any of the Examples 1-62.

Example 66 is a method to perform the operations of any of the Examples 1-62.

Language

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first." "second," and "third,"

etc. are used merely as labels, and are not intended to suggest a numerical order for their objects.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

The above detailed description includes references to the accompanying drawings, which form a part of the detailed description. The drawings show, by way of illustration, specific embodiments that may be practiced. These embodiments are also referred to herein as "examples" Such examples may include elements in addition to those shown or described. However, also contemplated are examples that include the elements shown or described. Moreover, also contemplated are examples using any combination or permutation of those elements shown or described (or one or more aspects thereof), either with respect to a particular example (or one or more aspects thereof), or with respect to other examples (or one or more aspects thereof) shown or described herein.

The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

The invention claimed is:

1. A system for assembling a set of connectable building blocks, the system comprising:

a processor and machine-readable media coupled to the processor, the machine-readable media comprising instructions which, when executed by the processor, cause the system to:

access, from wireless communication elements in each block of the set of blocks, general information regarding the set of blocks and specific information regarding at least one block of the set that is placed on a conducting mat and each block of the set that is connected to the at least one block on the conducting mat;

based on the general information and the specific information, access structural information regarding physical structures for assembly using the set of blocks;

receive a selection of one of the structures and generate a process for building the selected structure using the set of blocks, the process based on the general and specific information and the structural information associated with the selected structure; and cause a lighting element of the at least one block or one of the blocks to which it is connected to blink based on the process and cause a lighting element of at least one block of the set that is not connected to any other block of the set to blink based on the process, wherein the general information comprises a number of blocks of the set that is of a specific shape and a number of the blocks of the set of each specific shape that is of a specific color, wherein the specific information comprises at least one of: an assigned identification number, assigned identification numbers of the blocks to which it is connected, a position with respect to the conducting mat and the building blocks to which it is connected, a shape, or a color, wherein the specific information is stored in a respective memory of each block of the set, and wherein the machine-readable media further comprises instructions which, when executed by the processor, cause the system to determine the general information regarding the set of blocks based on the specific information of each block of the set, and wherein each block of the set includes sound, light, or proximity sensors, and wherein the specific information for a block of the set is not accessed based on the sound or light sensors detecting sound or light below respective sound or light threshold values or the proximity sensor not detecting any objects within a threshold distance.

2. The system of claim 1, the machine-readable media further comprising instructions which, when executed by the processor, cause the system to stop the lighting elements from blinking based on the at least one block of the set that is not connected to any other block being connected to the at least one block or one of the blocks to which the at least one block is connected.

3. The system of claim 1, wherein the structural information is accessed from a database of pre-defined physical structures for assembly using the set of blocks or from sources available via a network connection.

4. The system of claim 1, the machine-readable media further comprising instructions which, when executed by the processor, cause the system to re-access the structural information based on at least one block of the set without a blinking lighting element being connected to the at least one block or one of the blocks to which the at least one block is connected.

5. The system of claim 4, the machine-readable media further comprising instructions which, when executed by the processor, cause the system to: evaluate the stability of the connected blocks, and set the lighting element of the at least one block of the set without a blinking lighting element to be continuously illuminated as a warning that the connected blocks are being made unstable based on the connection of the at least one block of the set without a blinking lighting element.

6. The system of claim 1, the machine-readable media further comprising instructions which, when executed by the processor, cause the system to re-access the structural information based on the at least one block or one of the blocks to which the at least one block is connected being disconnected from at least one connected block.

7. The system of claim 1, wherein electrical power for the wireless communication elements, the memories, the sensors, and the lighting elements of each respective block of the set is provided by: a container for the set of blocks, the conducting mat, or another block of the set to which said respective block is connected.

8. The system of claim 1, wherein the wireless communication elements comprise Bluetooth, NFC, Wi-Fi, or radio communication elements.

9. The system of claim 1, wherein the lighting element of each respective block of the set includes an LED light of a specified color based on a color of the respective block of the set.

10. The system of claim 1, wherein the process defines a sequence of connections between specified blocks of the set in order to assemble the selected structure on the conducting mat.

11. The system of claim 10, wherein the blinking lighting elements blink in a specified pattern and wherein the frequency of the pattern increases as more of the specified blocks are connected according to the sequence.

12. At least one non-transitory machine-readable storage medium comprising instructions which, when executed by a processor of a machine, cause the machine to:

access, from wireless communication elements in each block of a set of blocks, general information regarding the set of blocks and specific information regarding at least one block of the set that is placed on a conducting mat and each block of the set that is connected to the at least one block on the conducting mat;

based on the general information and the specific information, access structural information regarding physical structures for assembly using the set of blocks;

receive a selection of one of the structures and generate a process for building the selected structure using the set of blocks, the process based on the general and specific information and the structural information associated with the selected structure; and cause a lighting element of the at least one block or one of the blocks to which it is connected to blink based on the process and cause a lighting element of at least one block of the set that is not connected to any other block of the set to blink based on the process, wherein the general information comprises a number of blocks of the set that is of a specific shape and a number of the blocks of the set of each specific shape that is of a specific color, wherein the specific information comprises at least one of: an assigned identification number, assigned identification numbers of the blocks to which it is connected, a position with respect to the conducting mat and the building blocks to which it is connected, a shape, or a color, wherein the specific information is stored in a respective memory of each block of the set, and wherein the machine-readable storage medium further comprises instructions which, when executed by the processor, cause the machine to determine the general information regarding the set of blocks based on the specific information of each block of the set, and wherein each block of the set includes sound, light, or proximity sensors, and wherein the specific information for a block of the set is not accessed based on the sound or light sensors detecting sound or light below respective sound or light threshold values or the proximity sensor not detecting any objects within a threshold distance.

13. The at least one non-transitory machine-readable storage medium of claim 12, further comprising instructions which, when executed by a processor of the machine, cause the machine to stop the lighting elements from blinking based on the at least one block of the set that is not connected to any other block being connected to the at least one block or one of the blocks to which the at least one block is connected.

14. The at least one non-transitory machine-readable storage medium of claim 12, further comprising instructions which, when executed by a processor of the machine, cause the machine to re-access the structural information based on at least one block of the set without a blinking lighting element being connected to the at least one block or one of the blocks to which the at least one block is connected.

15. The at least one non-transitory machine-readable storage medium of claim 12, further comprising instructions which, when executed by a processor of the machine, cause the machine to re-access the structural information based on the at least one block or one of the blocks to which the at least one block is connected being disconnected from at least one connected block.

16. The at least one non-transitory machine-readable storage medium of claim 12, wherein the specific information is stored in a respective memory of each block of the set, and wherein the machine-readable storage medium comprises instructions which, when executed by a processor of the machine, cause the machine to:

determine the general information regarding the set of blocks based on the specific information of each block of the set.

17. The at least one non-transitory machine-readable storage medium of claim 12, wherein the process defines a sequence of connections between specified blocks of the set in order to assemble the selected structure on the conducting mat.

18. A method for assembling a set of connectable building blocks, the method comprising:

accessing, from wireless communication elements in each block of the set of blocks, general information regarding the set of blocks and specific information regarding at least one block of the set that is placed on a conducting mat and each block of the set that is connected to the at least one block on the conducting mat;

based on the general information and the specific information, accessing structural information regarding physical structures for assembly using the set of blocks;

receiving a selection of one of the structures and generating a process for building the selected structure using the set of blocks, the process based on the general and specific information and the structural information associated with the selected structure; and causing a lighting element of the at least one block or one of the blocks to which it is connected to blink based on the process and causing a lighting element of at least one block of the set that is not connected to any other block of the set to blink based on the process, wherein the general information comprises a number of blocks of the set that is of a specific shape and a number of the blocks of the set of each specific shape that is of a specific color, wherein the specific information comprises at least one of: an assigned identification number, assigned identification numbers of the blocks to which it is connected, a position with respect to the conducting mat and the building blocks to which it is connected, a shape, or a color, wherein the specific information is stored in a respective memory of each block of the set, and wherein the general information regarding the set of blocks is determined based on the specific information of each block of the set, and wherein each block of the set includes sound, light, or proximity sensors, and wherein the specific information for a block of the set is not accessed based on the sound or light sensors detecting sound or light below respective sound or light threshold values or the proximity sensor not detecting any objects within a threshold distance.

19. The method of claim 18, further comprising stopping the lighting elements from blinking based on the at least one block of the set that is not connected to any other block being connected to the at least one block or one of the blocks to which the at least one block is connected.

* * * * *